US006021915A

United States Patent [19]

Shimozono et al.

[11] Patent Number: 6,021,915

[45] Date of Patent: Feb. 8, 2000

[54] FOLDABLE AND SIMPLIFIED WATER TANK

[75] Inventors: Kiichiro Shimozono; Norio Oishi; Toshiyuki Takeda, all of Tokyo, Japan

[73] Assignee: Fujimoro Kogyo Co Ltd, Tokyo, Japan

[21] Appl. No.: 08/714,980

[22] Filed: Sep. 17, 1996

[51] Int. Cl.[7] ..... B65D 33/00

[52] U.S. Cl. ..... 220/666; 383/107; 4/506

[58] Field of Search ..... 220/678, 666, 220/4.13, 4.16, 400; 383/113, 117, 107; 4/506

[56] References Cited

U.S. PATENT DOCUMENTS

| | | | |
|---|---|---|---|
| 2,674,287 | 4/1954 | Smith et al. | 220/666 |
| 2,854,049 | 9/1958 | Wyllie | 220/666 X |
| 2,952,397 | 9/1960 | Doyle | 383/107 X |
| 3,470,928 | 10/1969 | Schwartz | 383/107 X |
| 3,645,820 | 2/1972 | Widiger et al. | 383/107 X |
| 4,383,564 | 5/1983 | Hoie | 220/666 X |
| 4,706,307 | 11/1987 | Smith | 4/506 X |
| 4,865,096 | 9/1989 | Schober et al. | 383/107 |
| 4,935,970 | 6/1990 | Aristone | 4/506 X |
| 5,368,395 | 11/1994 | Crimmins | 383/107 |
| 5,592,702 | 1/1997 | Gillebaard, Jr. | 4/506 |
| 5,603,129 | 2/1997 | Chou | 220/666 X |

*Primary Examiner*—Steven Pollard

[57] ABSTRACT

A foldable and simplified water tank characterized by a cylindrical shape and a side wall formed by a sheet made from synthetic resin, and the stiffness of said sheet, measured in accordance with the measuring method prescribed in Japan Industrial Standard L-1096 is from 100 to 1000. The water tank can be made to stand up by itself by only pouring water into it.

14 Claims, 2 Drawing Sheets

FOLDABLE AND SIMPLIFIED WATER TANK

BACKGROUND OF THE INVENTION

This invention relates to a simple water tank which is foldable as a compact shape and have a feature of self standing up.

DISCLOSURE OF THE PRIOR ART

In general, water tanks made by foldable woven cloth are set up at necessary places as the simple folding water tank to meet the practical needs. Since this kind of water tanks can be folded to a compact size, it has a merit that does not need a big space for storing and transporting. However, it is difficult to maintain the shape against the hydraulic pressure of contained water when it is assembled at the practical use. Therefore, to maintain the original shape of it, frames or poles to support the tank are arranged, but the existence of these frames or poles lowers the efficiency for setting up, transportation and removal of the water tank, and is pointed up as a demerit of the conventional water tank.

OBJECT OF THE INVENTION

The inventors of this invention have conduced intensive studies to overcome the above mentioned disadvantage, and have and accomplished the present invention by finding out that the water tank which has a cylindrical shape and which is composed of a specified woven cloth can overcome the aforementioned disadvantage, that is, the water tank having such features does not need frames and poles and can be made to stand up by only pouring water into it. Thus the object of this invention is to provide a simplified water tank which has the feature of being self-supporting.

BRIEF SUMMARY OF THE INVENTION

The important points of this invention are that the tank have a cylindrical shape and that the tank be rendered self supporting by providing a side wall composed of a sheet made from synthetic resin characterized in that the stiffness of the side, as measured in accordance with the measuring method prescribed in Japan Industrial Standard (JIS)-L-1096, is from 100 to 1000.

In these drawings, "1" indicates a layer of thermo plastic resin, "2" indicates a woven cloth of synthetic resin flat yarn or filament, "3" indicates a welded zone of the side wall and "4" indicates a polyvinylchloride tube.

DETAILED DESCRIPTION OF THE INVENTION

The principle of this invention is illustrated in detail below.

The appearance of the water tank of this invention is a cylindrical shape. When it is practically used, the bottom of the tank is flatly extended and by pouring water into it, water pressure is equally given to the whole side wall surface so as to stand up the water tank without supports, e.g., frames or poles. Therefore, it can be said that the water tank of this invention not only has advantages of easy assembly and easy set up but also has an advantage that it can be located at any place where it is needed.

To maintain the stabilized shape of the water tank, it is preferable to insert a polyvinylchloride tube into the upper brim of the tank the tube being in the form of a circle.

Figure 5:
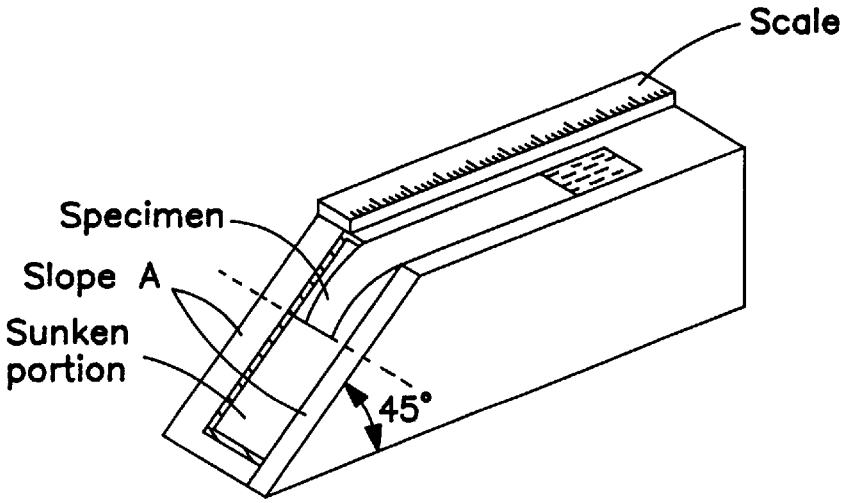
FIG. 5 is a perspective view of the device utilized to measure stiffness in accord with Method A (45° Cantilever Method) described in JIS-L-1096.

The waterproof sheet used in this invention must be a sheet which has a feature that the stiffness measured by method A (45° cantilever Method) described in JIS L-1096 "Testing Methods for Textiles" is restricted within a limit from 100 to 1000. (Method A (45° Cantilever Method) of JIS-L-1096 for measuring stiffness states: Take five test specimens, each measuring 2 cmxapproximately 15 cm, each in the warp and weft directions from the sample having been prepared in accordance with 3. Place the specimen on the horizontal table having 45° slope on one side and a smooth surface as shown in FIG. 5 so as to align the short end of the specimen with the base line of the scale. Then, slide the specimen slowly towards the slope by a suitable means, and read the position (mm) of the other end of the scale when the central point of the one end naturally comes in contact with slope A. The degree of stiffness is indicated by the moving distance of the specimen. The stiffness shall be measured both for the surface and for the back of each specimen. Express the stiffness in a digit of interger as average of the measurements made for the surface and back of five specimens each in the warp and weft directions.) The sheet with a stiffness measure lower than 100 does not provide the self-supporting feature, and the sheet with a stiffness measure of higher than 1000 provides the self-supporting feature but it is too rigid to fold and prevent easy handling and transport. The preferable limit of stiffness is a measured value of from 150 to 500.

Preferable examples of a sheet made of synthetic resin having the feature of the stiffness measured by JIS L-1096 being from 100 to 1000 are for instance, a woven cloth sheet using flat yarn made of synthetic resin of which both surfaces are laminated by thin layers of thermoplastic resin, or laminated sheet of plural woven cloth sheets using flat yarn made of synthetic resin of which the surfaces are laminated by thin layers of thermoplastic resin. As the woven cloth of flat synthetic resin yarn to be used in this invention, plane weave cloth of 10–20 yarn/inch density, woven with 1000–2000 denier high density polyethylene flat yarn can be mentioned. As the thermoplastic resin film to be laminated to said woven cloth, 40–400 $\mu$m thickness film of low density polyethylene (LDPE) film, linear low density polyethylene (LLDPE) film or copolymer film of ethylene-vinylacetate (EVA) can be used. As preferable examples, a plane weave cloth of 15×15 yarn/inch density, woven with 2000 denier high density polyethylene yarn to both surfaces of which 60 $\mu$m thickness film of linear low density polyethylene is laminated, or a sheet where two such cloths are laminated can be mentioned.

The material of the bottom of the tank is not restricted, however, it is desirable from the view point of manufacturing to prefer the materials which can be welded easily with the materials composing the side wall. Therefore, it is more desirable to use the same materials used in the side. Also the size of the water tank is not restricted, however in general, the diameter is from 1 to 10 meters the height is from 0.5 to 2.0 meters especially, the water tank having a size of about 4 meters diameter and 1.2 meters height is practically used.

The water tank of this invention can be manufactured by welding two opposite edges of the sidewall sheet so as to prepare a cylinder, and then connect a bottom sheet to one open end opening of the cylinder.

Figure 1:
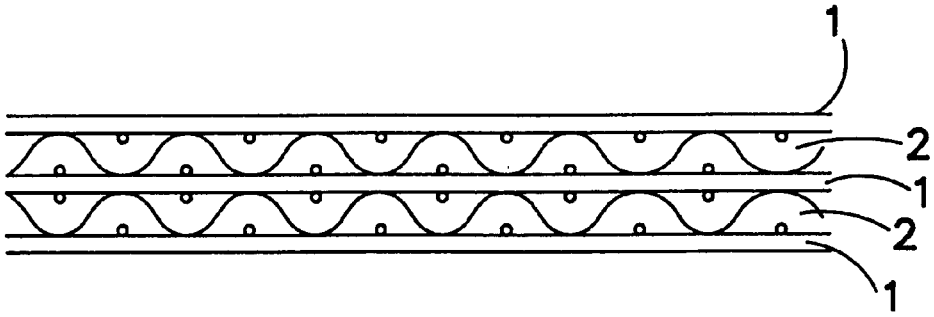
FIG. 1 is a cross-sectional view illustrating a layer structure of the synthetic resin sheet used in this invention.
Figure 2:
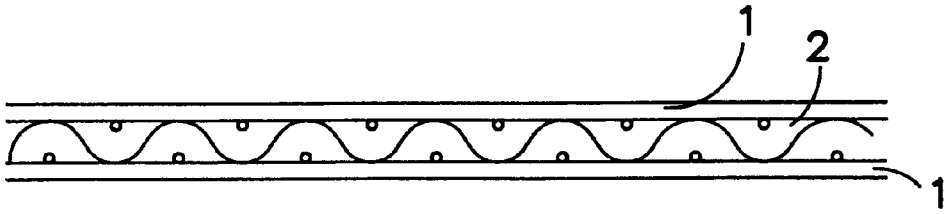
FIG. 2 is a cross-sectional view illustrating another example of a layer structure of the synthetic resin sheet used in this invention.
Figure 3:
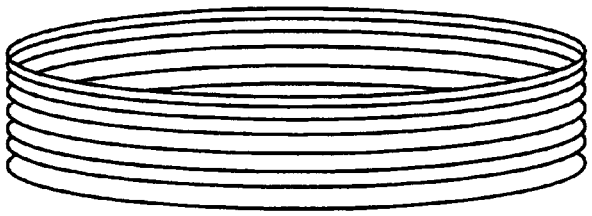
FIG. 3 is a perspective view of the water tank when the bottom is extended (not in actual use).
Figure 4:
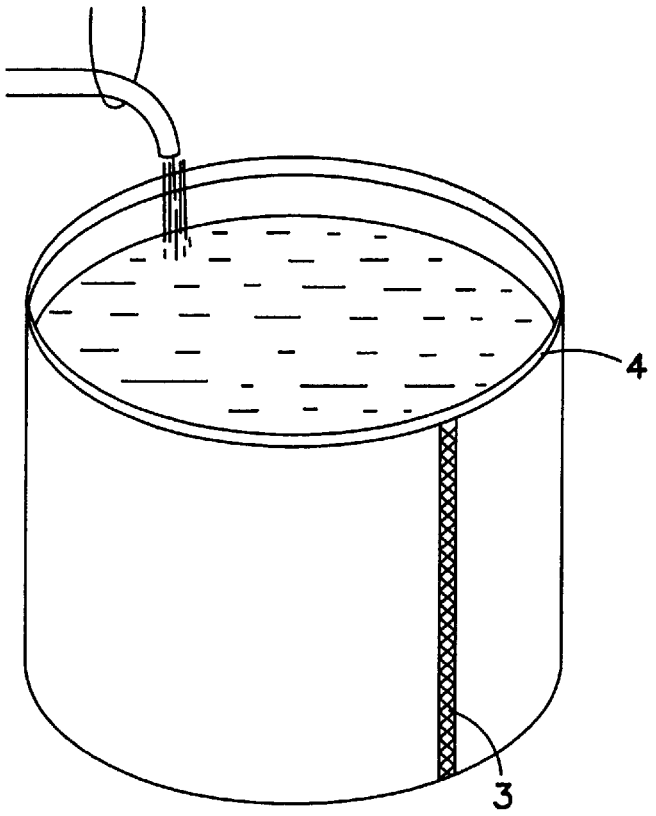
FIG. 4 is a perspective view of the water tank (in actual use).

This invention is illustrated in the drawings. FIGS. 1 and 2 are cross-sectional views showing the layer structure of the synthetic resin sheet used in this invention, FIG. 3 is a perspective view showing the shape of the water tank of this invention when the bottom part is extended and FIG. 4 is a perspective view of the water tank when filled with water. In FIGS. 1 and 2, the woven cloth of flat yarn or filament made from synthetic resin is designated "2", and the layer of thermoplastic synthetic resin laminated to the said woven cloth is designated "1". In FIGS. 3 and 4, "3" indicates welded zone of the side wall and "4" indicates a polyvinylchloride tube, which is desirably inserted into the upper brim of the water tank so as to maintain the original circular shape.

The relationship between the features of the sheet and the self-supporting ability of the water tank is illustrated by the following Examples.

EXAMPLE 1

A water proof sheet produced by laminating a 60$\mu$ thickness LLDPE film to both surface of a plane weave polyethylene cloth, which is prepared by weaving high density polyethylene flat yarn of 2000 denier so that the woven density for warp and weft direction is 15 yarn/inch, is used as the material for this Example. When polyethylene cloth is indicated by "L" and film is indicated by "P", the composition of this waterproof sheet is indicated by P.L.P. Measuring results for stiffness of this sheet are shown in Table 1. These results are obtained in accordance with stiffness measuring method A of JIS-L-1096. The said sheet is processed to form a circular simplified water tank of 1.2 height and 4 diameter by using welding procedure. The whole bottom of the folded up water tank is extended, then 14 tons of water are poured into the tank to a height of 1.1 meter without lifting the side wall part. Just then the side wall part stands up by itself and forms a circular water tank.

EXAMPLE 2

Same as to EXAMPLE 1, a water proof sheet produced by laminating a 60$\mu$ thickness LLDPE film (P) to both surfaces of a plane weave polyethylene cloth (L), which is prepared by weaving high density polyethylene flat yarn of 2000 denier so that the woven density for warp and weft directions is 15 filaments/inch is prepared. Further, another same sheet of polyethylene cloth and LLDPE film is laminated to the first sheet. The composition of the obtained waterproof sheet is indicated as P•L•P•L•P. Measuring results for bending resistance of this sheet are shown in Table 1. The said sheet is processed to a circular simplified water tank of 1.2 meters height and 4 meters diameter by using welding procedure. After the whole bottom of the folded up water tank is extended and 14 tons of water are poured into the tank to the 1.1 meters height without lifting the side wall part, just then the side wall part stands up by itself and forms a circular water tank.

COMPARATIVE EXAMPLE

A waterproof sheet produced by laminating a 200$\mu$ thick soft polyvinyl chloride film (P) to both surfaces of a plane weave polyethylene terephthalate cloth, which is prepared by weaving multiple polyethylene terephthalate filaments so that the woven density in the warp direction is 22 filaments/inch and that of the weft direction is 21 filaments/inch, is used as the material for this Comparative Example. The composition of the obtained sheet is indicated as P•L•P, and measuring results for stiffness of this sheet are shown in table 1. By using this waterproof sheet, a similar experiment to Example 1 is carried out. However, the side wall part cannot stand up by itself and cannot form a circular water tank.

TABLE 1

| | stifness | | | | self |
|---|---|---|---|---|---|
| | right side | | reverse side | | standing |
| | warp | weft | warp | weft | feature |
| EXAMPL 1 | 181 | 220 | 165 | 213 | ○ |
| EXAMPL 2 | 325 | 365 | 305 | 310 | ○ |
| COM EXPL | 70 | 75 | 63 | 69 | X |

As above mentioned, since the water tank of this invention is characterized by a cylindrical shape, when water is poured into it, the water pressure is equally given to the whole side wall surface as to stand up the water tank by itself. And, since the water tank does not need frames and poles, it promises easy handling. Therefore, for instance, it can be practically applied as a storage tank for sea water used for cultivation of laver.

What is claimed is:

1. A foldable water tank having a self-standing sidewall comprising:

a cylindrical side wall having an upper circular edge and a lower circular edge, said cylindrical side wall being formed of a first waterproof sheet made from synthetic resin, said sheet made from synthetic resin having a stiffness, as measured by Method A of Japanese Industrial Standard L-1096, of from 100 to 1000 mm;

a bottom water-tightly bonded to said lower circular edge of said cylindrical side wall, said bottom being formed of a waterproof sheet made from synthetic resin.

2. The foldable water tank according to claim 1, wherein the first waterproof sheet made from synthetic resin comprises a woven cloth sheet of flat yarn or filament made of synthetic resin sandwiched between two layers of thermoplastic resin to form a laminate.

3. The foldable water tank according to claim 2, wherein said woven cloth sheet is a plane weave cloth of 10–20 yarn/inch density of 1000–2000 denier high density polyethylene flat yarn; and said layers of thermoplastic resin are 40–400 $\mu$m thick films of low density polyethylene, linear low density polyethylene or ethylene-vinylacetate copolymer.

4. The foldable water tank according to claim 2, wherein said upper circular edge of said cylindrical side wall has a brim and a hollow tube is disposed within said brim.

5. The foldable water tank according to claim 4, wherein said hollow tube is formed of polyvinylchloride.

6. The foldable water tank according to claim 1, wherein the first waterproof sheet made from synthetic resin comprises two woven cloth sheets of flat yarn or filament interleaved between three layers of thermoplastic resin to form a laminate.

7. The foldable water tank according to claim 6, wherein said woven cloth sheets are plane weave cloths of 10–20 yarn/inch density of 1000–2000 denier high density polyethylene flat yarn; and said layers of thermoplastic resin are 40–400 μm thick films of low density polyethylene, linear low density polyethylene or ethylene-vinylacetate copolymer.

8. The foldable water tank according to claim 6, wherein said upper circular edge of said cylindrical side wall has a brim and a hollow tube is disposed within said brim.

9. The foldable water tank according to claim 8, wherein said hollow tube is formed of polyvinylchloride.

10. The foldable water tank according to claim 1, wherein said first waterproof sheet made from synthetic resin has a stiffness, as measured by Method A of Japanese Industrial Standard L-1096, of from 150 to 500 μm.

11. The foldable water tank according to claim 1, wherein said upper circular edge of said cylindrical side wall has a brim and a hollow tube is disposed within said brim.

12. The foldable water tank according to claim 11, wherein said hollow tube is formed of polyvinylchloride.

13. The foldable water tank according to claim 1, wherein said cylindrical side wall has a diameter of 1–10 meters and a height of 0.5–2.0 meters.

14. The foldable water tank according to claim 13, wherein said cylindrical side wall has a diameter of about 4 meters and a height of about 1.2 meters.

* * * * *